US010138828B2

(12) United States Patent
Kimoto et al.

(10) Patent No.: US 10,138,828 B2
(45) Date of Patent: Nov. 27, 2018

(54) EVAPORATED FUEL PROCESSING DEVICES

(71) Applicant: AISAN KOGYO KABUSHIKI KAISHA, Obu-shi, Aichi-ken (JP)

(72) Inventors: Junya Kimoto, Obu (JP); Yoshikazu Miyabe, Obu (JP)

(73) Assignee: AISAN KOGYO KABUSHIKI KAISHA, Obu-Shi, Aighi-Ken (JP)

( * ) Notice: Subject to any disclaimer, the term of this patent is extended or adjusted under 35 U.S.C. 154(b) by 105 days.

(21) Appl. No.: 15/507,880

(22) PCT Filed: Aug. 27, 2015

(86) PCT No.: PCT/JP2015/074148
§ 371 (c)(1),
(2) Date: Mar. 1, 2017

(87) PCT Pub. No.: WO2016/035657
PCT Pub. Date: Mar. 10, 2016

(65) Prior Publication Data

US 2017/0284321 A1 Oct. 5, 2017

(30) Foreign Application Priority Data

Sep. 1, 2014 (JP) ..... 2014-176955

(51) Int. Cl.
*F02D 41/00* (2006.01)
*F02D 41/24* (2006.01)
*F02M 25/08* (2006.01)

(52) U.S. Cl.
CPC ..... *F02D 41/0042* (2013.01); *F02D 41/004* (2013.01); *F02D 41/2464* (2013.01);
(Continued)

(58) Field of Classification Search
CPC ..... F02D 41/0042; F02D 41/2464; F02M 25/0854; F02M 25/0836
See application file for complete search history.

(56) References Cited

U.S. PATENT DOCUMENTS 5,560,340 A * 10/1996 Tomisawa ..... F02D 41/32 123/494
6,305,361 B1 * 10/2001 Takaku ..... F02M 25/0809 123/198 D (Continued)

FOREIGN PATENT DOCUMENTS

JP 2005-002987 A 1/2005
JP 2011-256778 A 12/2011

(Continued)

OTHER PUBLICATIONS

International Patent Application No. PCT/JP2015/074148 International Search Report dated Nov. 17, 2015 (5 pages).

(Continued)

*Primary Examiner* — Hung Q Nguyen
*Assistant Examiner* — Brian P Monahon
(74) *Attorney, Agent, or Firm* — Conley Rose, P.C.

(57) ABSTRACT

An evaporated fuel processing device utilizing a flow rate control valve as a valve positioned in a passage connecting a fuel tank with a canister. The device includes: a valve opening means for opening the flow rate control valve at a constant speed; an internal pressure sensor; a valve opening start position detecting means for acquiring a second derivative value of the internal pressure after a valve opening motion of the flow rate control valve has started and for detecting a valve opening start position of the flow rate control valve based on the second derivative value; a learning means for storing the valve opening start position; and a valve opening speed change means for changing a valve opening speed of the valve opening means based on a (Continued)

variation speed of the internal pressure before the valve opening motion of the flow rate control valve has started.

16 Claims, 7 Drawing Sheets

(52) U.S. Cl.
CPC .... *F02M 25/0809* (2013.01); *F02M 25/0818* (2013.01); *F02M 25/0836* (2013.01); *F02M 25/0854* (2013.01)

(56) References Cited

U.S. PATENT DOCUMENTS 6,354,281 B1 * 3/2002 Mitsutani ..... F02D 41/0032 123/520
6,367,459 B1 * 4/2002 Yoshioka ..... F02D 41/0035 123/516
6,378,505 B1 * 4/2002 Doering ..... F02M 25/0809 123/198 D
6,390,075 B1 * 5/2002 Yamazaki ..... F02M 21/0242 123/529
6,698,280 B1 * 3/2004 Iden ..... F02M 25/0818 73/114.38
7,040,302 B2 5/2006 Yamaguchi et al.
8,118,011 B2 2/2012 Hirose
8,584,654 B2 * 11/2013 Closet ..... F02M 25/0809 123/520
9,243,593 B2 * 1/2016 Hagen ..... B60K 15/03519
9,284,923 B2 3/2016 Kimoto et al.
9,689,324 B2 * 6/2017 Akita ..... F02D 41/003
2001/0027682 A1 * 10/2001 Takagi ..... F02M 25/0818 73/114.41
2004/0089063 A1 * 5/2004 Matsubara ..... F02M 25/0818 73/114.41
2006/0052931 A1 * 3/2006 Shikama ..... F02M 25/0827 701/114
2008/0059039 A1 * 3/2008 Nakagawa ..... F02D 41/2464 701/99
2011/0166765 A1 * 7/2011 DeBastos ..... B60K 15/03504 701/102
2011/0220071 A1 9/2011 Horiba et al.
2012/0097269 A1 * 4/2012 Horiba ..... F02M 25/0854 137/551
2013/0174813 A1 * 7/2013 Miyata ..... F02M 25/08 123/520
2014/0102420 A1 * 4/2014 Kimoto ..... F02M 25/0836 123/520
2014/0116402 A1 * 5/2014 Horiba ..... F02M 25/0836 123/520
2014/0299111 A1 * 10/2014 Denz ..... F02M 35/1038 123/521
2015/0114361 A1 * 4/2015 Matsunaga ..... F02M 25/0818 123/520

FOREIGN PATENT DOCUMENTS

JP 2012-172561 A 9/2012
JP 5167023 B2 3/2013
JP 2014-077422 A 5/2014

OTHER PUBLICATIONS

Japanese Office Action dated Nov. 27, 2017, for Japanese Application No. 2016-546596 (4 p.).
English Translation of Japanese Office Action dated Nov. 27, 2017, for Japanese Application No. 2016-546596 (4 p.).

* cited by examiner

EVAPORATED FUEL PROCESSING DEVICES

CROSS-REFERENCE TO RELATED APPLICATIONS

The present application is a National Phase entry of, and claims priority to, PCT Application No. PCT/JP2015/074148, filed Aug. 27, 2015, which claims priority to Japanese Patent Application No. 2014-176955, filed Sep. 1, 2014, both of which are incorporated herein by reference in their entireties for all purposes.

STATEMENT REGARDING FEDERALLY SPONSORED RESEARCH OR DEVELOPMENT

Not applicable.

BACKGROUND

The present disclosure relates to an evaporated fuel processing device utilizing a flow rate control valve as a valve positioned in a passage connecting a fuel tank with a canister. The valve is maintained in a valve closed state when the stroke amount, representing the axially traveled distance of a movable valve part relative to a valve seat from an initial state of the valve, is less than or equal to a predetermined cutoff level, so as to allow the fuel tank to be maintained in a sealed state.

Japanese Laid-Open Patent Publication No. 2011-256778 discloses an evaporated fuel processing device equipped with the above-described flow rate control valve as a valve positioned in a passage connecting a fuel tank with a canister. A movable valve part of the flow rate control valve needs to be moved a predetermined amount in a valve-opening direction from an initial state of the valve, after a valve opening motion has started, in order to reach a valve opening start position where the valve is open to a degree where the fuel tank can communicate with the canister through the passage. The valve opening start position is learned in advance so that a normal valve opening control would start from the pre-learned valve opening start position in order to rapidly control the valve opening for flow rate control. For this learning to occur, the valve opening start position must be detected, where this detection of the opening start position is executed through detecting a reduction of the internal pressure of the fuel tank at said position.

BRIEF SUMMARY

However, since the internal pressure of the fuel tank may also vary in accordance with the environment in which the fuel tank is installed, it presents a conflating factor, where the valve open start position may be incorrectly detected because of the reduction of the internal pressure due to not only moving of the valve position but also the environment. For example, if a large quantity of vapor is generated in a space within the fuel tank, the internal pressure of the tank is increased due to the vapor, aside from any movement of the valve, such that the predetermined reduction of inner pressure may not be caused due to the valve moving to the valve opening start position.

In view of this problem, the present disclosure of the evaporated fuel processing device, utilizing the above-mentioned flow rate control valve as a valve provided in a passage connecting a fuel tank with a canister, detects the valve opening start position exactly and rapidly regardless of the environment in which the fuel tank is installed, by detecting the valve opening start position as the degree of opening of the valve where the fuel tank and the canister can start to communicate with each other through the passage, under the consideration of the variations of the fuel tank internal pressures after a valve opening motion of the flow rate control valve has started and by changing valve opening speed of the flow rate control valve in accordance with the variations of the fuel tank internal pressures.

The first aspect according to the present disclosure is an evaporated fuel processing device configured to adsorb evaporated fuel within a fuel tank in the canister and supply the adsorbed evaporated fuel to an engine, utilizing a flow rate control valve as a valve positioned in a passage connecting the fuel tank with the canister, which is maintained in a valve closed state when the stroke amount, representing the axially traveled distance of a movable valve part relative to a valve seat from an initial state of the valve, is less than or equal to a predetermined cutoff level so as to allow the fuel tank to be maintained in a sealed state. The evaporated fuel processing device comprises a valve opening means for opening the flow rate control valve from a valve closed state at a predetermined speed, an internal pressure sensor for detecting a space pressure within the fuel tank as an internal pressure, a valve opening start position detecting means for acquiring a second derivative value of the internal pressure detected by the internal pressure sensor after the valve opening motion of the flow rate control valve has started and for detecting a valve opening start position of the flow rate control valve based on the second derivative value, a learning means for storing the valve opening start position detected by the valve opening start position detecting means as a learned value when valve opening control of the flow rate control valve is performed, and a valve opening speed change means for changing a valve opening speed of the valve opening means based on the variation speed of the internal pressure detected by the internal pressure sensor.

According to the first aspect of the disclosure, for the valve opening speed change means, the internal pressure may vary both when the pressure is increased or decreased. The valve opening speed is changed by the valve opening means to be slow in the former case and to be quick in the latter case.

Evaporated fuel is supplied to an engine through communication between the fuel tank and the canister after the flow rate control valve has started to open and reached a valve opening start position. At this time, the air-fuel ratio in the engine is immediately changed due to the influence of the evaporated fuel. As a result, the valve opening start position of the flow rate control valve can be detected by detecting this change in the air-fuel ratio. In the present disclosure, the valve opening start position of the flow rate control valve is detected based on the second derivative value of the fuel tank internal pressure detected by the internal pressure sensor. However, the valve opening start position can also be more accurately detected when the detection of the change in the above-described air-fuel ratio is used together with the fuel tank internal pressure detected by the internal pressure sensor. Further, instead of the air-fuel ratio, it is also possible to detect the valve opening start position by detecting change in a feedback correction amount of the air-fuel ratio, which is used for an air-fuel ratio control in the engine, and by using this detected result together with the fuel tank internal pressure detected by the internal pressure sensor.

A response to the variations in the fuel tank internal pressures due to opening of the flow rate control valve changes in accordance with the variation speed of the fuel tank internal pressure change caused under conditions other than the opening and the closing of the flow rate control valve. For example, this response will be slower as rising speed of the internal pressure is higher while the internal pressure is rising due to increase of the evaporated fuel. In this case, this response occurs because if the opening speed of the flow rate control is fast while the rising speed of the internal pressure is high, then the valve opening start position cannot be accurately detected due to the delay of the detection of the valve opening start position, where, due to the internal pressure rise speed from the increase of the evaporated fuel, the internal pressure varies at the point in time after having already passed the valve opening start position. The problem of detection delay of the valve opening start position can be solved if the opening speed of the flow rate control valve is always reduced. In solving the problem in this manner, however, a long time is required from the start of flow rate control valve opening until the valve opening start position will be detected. Namely, it may cause a problem of taking time for the learning control steps of the valve opening start position to be executed. According to the present disclosure, it is possible to prevent an increase in time for learning while the accuracy in detection of the valve opening start position is enhanced because the opening speed of the flow rate control valve is changed in response to the variation speed of the fuel tank internal pressure.

According to the second aspect of the present disclosure corresponding to the above-mentioned first aspect, the valve opening means is configured to increase a valve opening amount of the flow rate control valve stepwise by a predetermined amount in a predetermined cycle. The valve opening speed change means changes the predetermined cycle for increasing the valve opening amount by the valve opening means in response to the variation speed of the internal pressure.

According to the third aspect of the present disclosure corresponding to the first and/or second aspects, the valve opening means increases a valve opening amount of the flow rate control valve stepwise by a predetermined amount in a predetermined cycle. Further, the valve opening amount is further increased for a predetermined period of time, in order to keep the valve opened when the valve opening amount is stepwise increased. The valve opening speed change means changes the time for keeping the valve opened by the valve opening means in response to the variation speed of the internal pressure.

According to the fourth aspect of the present disclosure corresponding to the first, second, and/or third aspects, the valve opening speed change means changes the valve opening speed by the valve opening means based on the variation speed of the internal pressure detected by the internal pressure sensor before the start of the valve opening motion of the flow rate control valve by the valve opening means.

According to the fifth aspect of the present disclosure corresponding to the first aspect, the valve opening speed change means reduces the valve opening speed in response to the acceleration in increasing speed of the internal pressure.

According to the sixth aspect of the present disclosure corresponding to the second and/or third aspects, the valve opening speed change means extends the predetermined cycle of the valve opening means in response to the acceleration in increasing speed of the internal pressure.

According to the seventh aspect of the present disclosure corresponding to the third aspect, the valve opening speed change means increases the time for keeping the valve opened by the valve opening means in response to the acceleration in increasing speed of the internal pressure.

DETAILED DESCRIPTION

Figure 1:
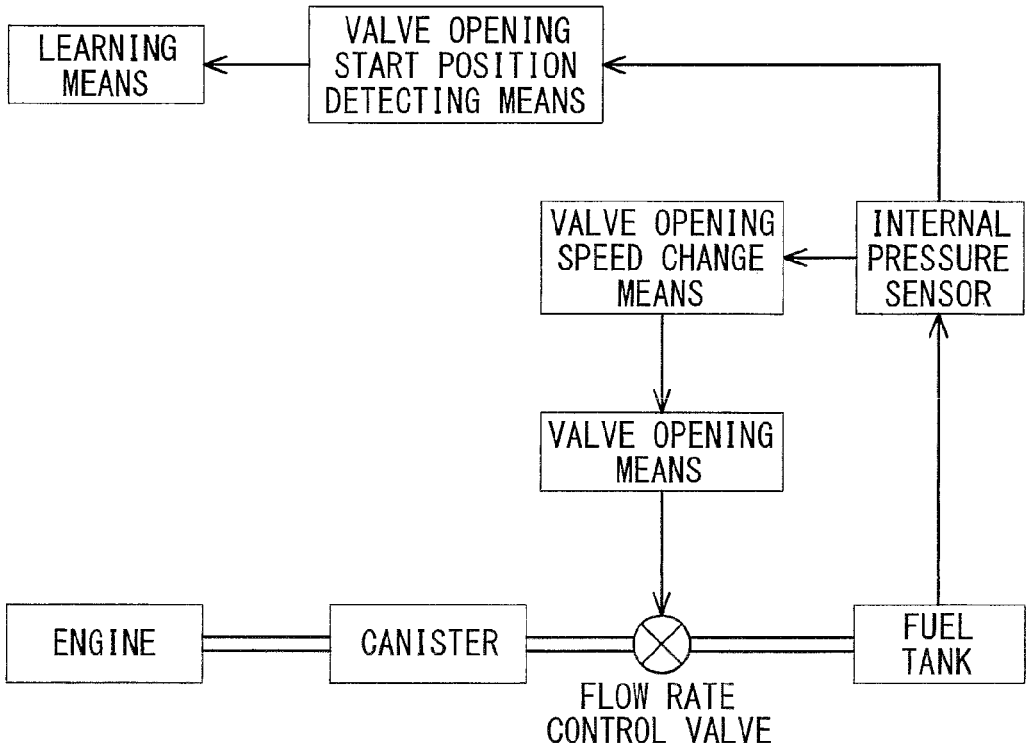
FIG. 1 is a schematic chart corresponding to the present disclosure.

FIG. 1 is a schematic chart corresponding to the first aspect of the present disclosure. The explanation thereof herein will be omitted to avoid repetition.

Figure 2:
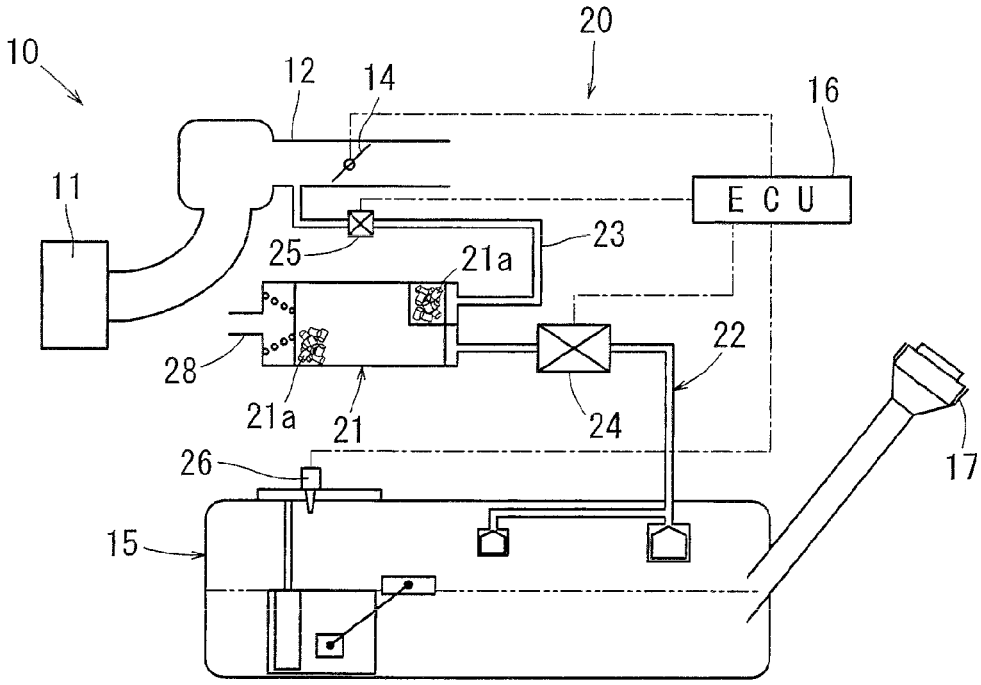
FIG. 2 is a system configuration diagram according to one exemplary embodiment of the present disclosure.

FIGS. 2 to 6 illustrate one exemplary embodiment of the present disclosure. According to this embodiment, an engine system 10 for a vehicle includes an evaporated fuel processing device 20 as shown in FIG. 2.

An engine system 10 shown in FIG. 2 supplies air-fuel mixture comprising fuel in air through an intake passage 12 to an engine main body 11. The air is supplied at a flow rate controlled by a throttle valve 14, and the fuel is supplied at a flow rate controlled by a fuel injection valve (not shown). Both the throttle valve 14 and the fuel injection valve are connected to a control circuit 16. The throttle valve 14 transmits signals relating to a valve opening amount of the throttle valve 14 to the control circuit 16. The valve opening time of the fuel injection valve is controlled by the control circuit 16. The fuel supplied to the fuel injection valve is fed from the fuel tank 15.

The evaporated fuel processing device 20 comprises a canister 21 to adsorb fuel vapor generated during oil feeding or fuel vapor evaporated within the fuel tank 15 (hereinafter referred to as evaporated fuel) via a vapor passage 22. The evaporated fuel adsorbed in the canister 21 is supplied to the intake passage 12 on the downstream side of the throttle valve 14 via a purge passage 23. A step-motor-type closing valve (corresponding to the flow rate control valve in the present disclosure, and hereinafter referred to as a closing valve) 24 is provided in the vapor passage 22 for opening and closing said passage 22, and a purge valve 25 is provided in the purge passage 23 for opening and closing the purge passage 23.

The closing valve 24 is maintained in a valve closed state when a stroke amount, which represents the axially traveled distance of a movable valve part relative to a valve seat from an initial state of the valve after the stepping motor has started a valve opening motion, is less than or equal to a predetermined amount. Therefore, because the stroke amount is less than or equal to the predetermined amount, the fuel tank 15 can be maintained in a sealed state. Further, the stroke amount can be continuously changed. When the stroke amount is changed to exceed beyond the predetermined amount, the closing valve 24 shifts into the valve opened state such that the fuel tank 15 is able to communicate through the valve in the vapor passage 22 with the canister 21. This position where the stroke amount reaches and exceeds the predetermined amount, corresponds to the valve opening start position of the present disclosure.

The canister 21 is filled with activated carbon 21*a*, which serves as an adsorbent material. The activated carbon 21*a* is configured to adsorb the evaporated fuel from the vapor passage 22 and discharge this adsorbed evaporated fuel to the purge passage 23. An atmospheric passage 28 is also connected to the canister 21 so that the atmospheric pressure is supplied via the atmospheric passage 28. If the intake pressure applied to canister 21 is negative via purge passage 23 atmospheric air is supplied via the atmospheric passage 28, to boost the pressure so that the evaporated fuel may be purged through the purge passage 23. The atmospheric passage 28 is configured to intake the atmospheric air from the vicinity of a fuel supply port 17 provided at the fuel tank 15.

The control circuit 16 receives various signals that are necessary for controlling valve opening time, etc., for the fuel injection valve. In addition to valve opening amount signals for said throttle valve 14, detection signals from a pressure sensor 26 (corresponding to an internal pressure sensor of the present disclosure, hereinafter referred to as the internal pressure sensor) are received in the control circuit 16 for detecting the internal pressure in the fuel tank 15. In addition to said valve opening time control for the fuel injection valve, the control circuit 16 executes a valve opening control for the closing valve 24 and for the purge valve 25 as indicated by the dot-dash lines indicating electrical communication as shown in FIG. 2. The internal pressure sensor 26 detects the gauge pressure relative to the atmospheric pressure. However, it may instead also detect the absolute pressure.

Figure 3:
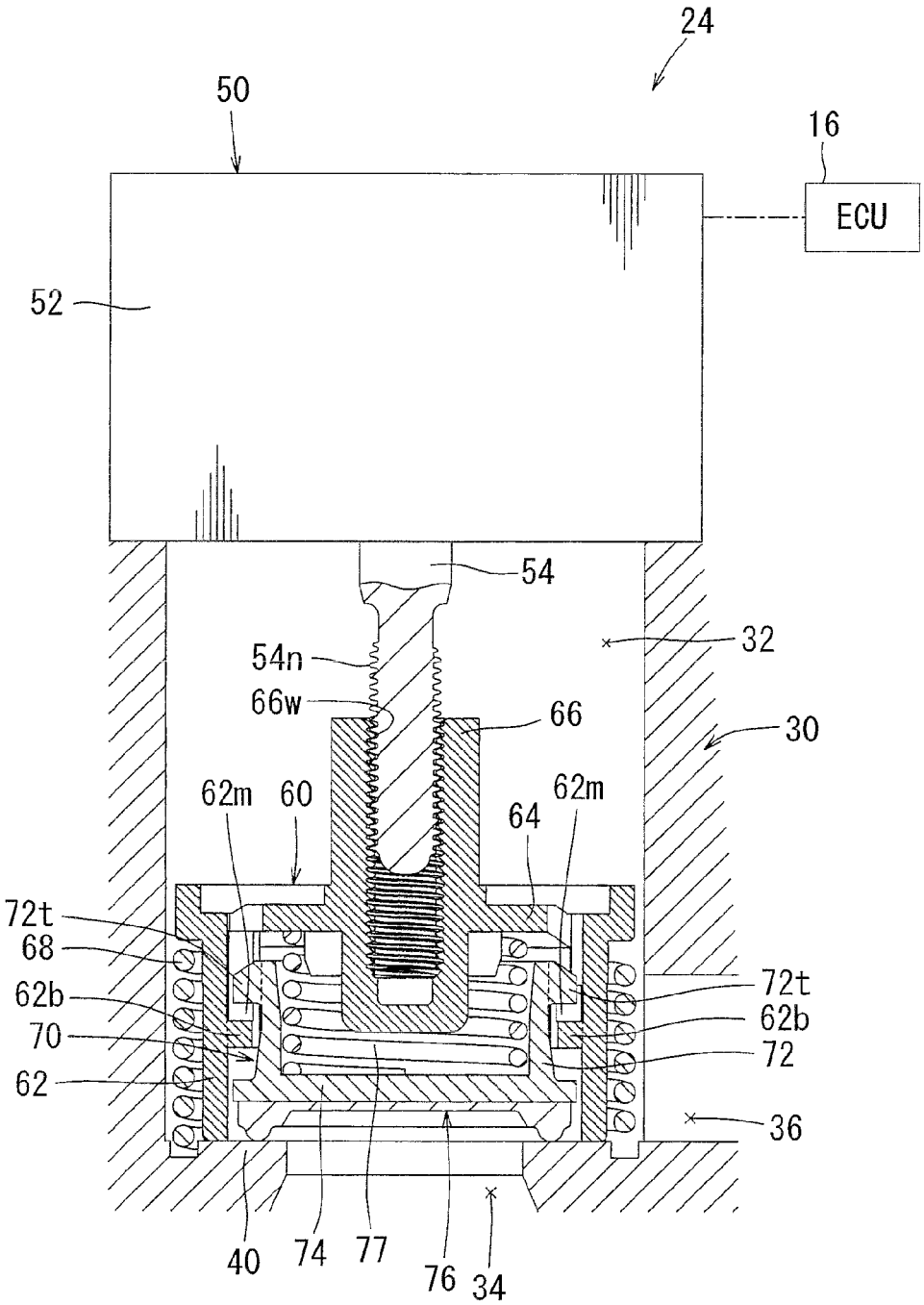
FIG. 3 is a longitudinal sectional view of the flow rate control valve of the FIG. 2 exemplary embodiment showing an initial state.

FIG. 3 illustrates a structure of the closing valve 24. The closing valve 24 includes a substantially cylindrical valve guide 60 which is concentrically arranged within a cylindrical valve chamber 32 of the valve casing 30, and a substantially cylindrical valve body 70 which is concentrically arranged within the valve guide 60. Meanwhile, an inflow passage 34, which is in communication with and connected to the vapor passage 22 on the fuel tank 15 side, is formed at the center of the lower end of the valve chamber 32 of the valve casing 30. Further, an outflow passage 36, which is in communication with and connected to the vapor passage 22 on the canister 21 side, is formed on a side wall of the valve chamber 32 of the valve casing 30. Furthermore, a motor main body 52 of a stepping motor 50 is provided at an upper end vertically opposed to the lower end where the inflow passage 34 for the valve casing 30 is formed, wherein the motor main body 52 closes the upper end of the valve chamber 32.

The valve guide 60 and the valve body 70 constitute a valve movable part of the present disclosure. A circular valve seat 40 is concentrically formed with inflow passage 34, around the outer radial opening edge of inflow passage 34, at the lower end of the valve casing 30. The closing valve 24 is shifted into the valve closed state as the valve guide 60 and the valve body 70 abut the valve seat 40. The closing valve 24 is shifted into the valve opened state as the valve guide 60 and the valve body 70 move away from the valve seat 40.

The valve guide 60 is formed as a cylinder with a top having a cylindrical tube wall portion 62 and an upper wall portion 64 closing the upper end opening of the tube wall portion 62. A tubular tube shaft portion 66 is concentrically formed in a radially central portion of the upper wall portion 24 with a female threaded portion 66*w* formed on the radially inner peripheral surface of the tube shaft portion 66. A male threaded portion 54*n* formed on an outer peripheral surface of an output shaft 54 of the stepping motor 50 is screwed into the female threaded portion 66*w* formed on the tube shaft portion 66 of the valve guide 60. The valve guide 60 is movably arranged in an axial direction (vertical direction) while being prevented from rotating with respect to the valve casing 30 by a rotation stopper means (not shown). Therefore, due to this structural configuration, the valve guide 60 is configured to be movable up and down in a vertical direction (axial directions based on forward and reverse rotation of the output shaft 54 of the stepping motor 50. Further, an auxiliary spring 68 for biasing the valve guide 60 upwardly is provided around the valve guide 60.

The valve body 70 is formed as a cylinder with a bottom having a cylindrical tube wall portion 72 and a lower wall portion 74 closing the lower end opening of the tube wall portion 72. A seal member 76 made of, for example, a circular disc-shaped rubber elastic member is attached to the lower surface of the lower wall portion 74. The seal member 76 of the valve body 70 is arranged to be able to contact the upper surface of the valve seat 40 of the valve casing 30.

A plurality of connection protrusions 72*t* are formed in a circumferential direction on the outer peripheral surface of the upper end of the tube wall portion 72 of the valve body 70. In contrast, vertical groove-like connection grooves 62*m* are formed on the inner peripheral surface of the tube wall portion 62 of the valve guide 60 pointing radially inwards from the valve guide 62 so as to correspond to each connection protrusion 72*t* of the valve body 70. Therefore, each connection protrusion 72*t* of the valve body 70 is fitted in each connection recess 62*m* of the valve guide 60 so as to be relatively movable in a vertical direction. The valve guide 60 and the valve body 70 can move together upwardly (in a valve opening direction) when the bottom wall portion 62*b* of the connection protrusion 62*m* on the valve guide 60 contacts the connection protrution 72*t* of the valve body 70 from below when the valve guide moves upward. A valve spring 77 is concentrically arranged between the upper wall portion 64 of the valve guide 60 and the lower wall portion 74 of the valve body 70 so that the valve spring 77 always biases the valve body 70 downwardly with respect to the valve guide 60 i.e., in a valve closed direction.

The basic motion of the closing valve 24 will be described as follows.

The closing valve 24 is operated to rotate by the stepping motor 50 in the valve open direction or the valve close direction by a predetermined number of steps, based on the output signal from the ECU 16. More specifically, the valve guide 60 moves in a vertical direction by a predetermined stroke amount, corresponding to a predetermined number of steps, wherein due to the thread engagement effect between the male threaded portion 54*n* on the output shaft 54 of the stepping motor 50 and the female threaded portion 66*w* in the tube shaft portion 66 of the valve guide 60, as the stepping motor 50 rotates a predetermined number of steps, the valve guide is able to move in a vertical direction. For example, the closing valve 24 is configured to have the number of steps at about 200 steps, corresponding to a stroke amount of about 5 mm, for going from the initial state to the entirely opened position.

As shown in FIG. 3, when the closing valve 24 is in an initialized state (the initial state), the valve guide 60 is held in the lower most position so that the lower circumferential end surface of the tube wall portion 62 of the valve guide 60 abuts against the upper surface of the valve seat 40 of the valve casing 30. Further, under this condition, the connection protrusions 72*t* of the valve body 70 are positioned above the bottom wall portion 62 of the valve guide 60, and the seal member 76 of the valve body 70 presses downward against the upper surface of the valve seat 40 of the valve casing 30 due to the spring force of the valve spring 77. That is, the closing valve 24 is initially held in the entirely closed state. At this time, the number of steps of the stepping motor 50 is 0 steps and a travel distance of the valve guide 60 in an axial direction (upward direction), i.e., the stroke amount in the valve opening direction is 0 mm.

While a vehicle is parking, the stepping motor 50 of the closing valve 24 rotates, for example, by 4 steps from the initializing state in the valve open direction. As a result, the valve guide 60 moves about 0.1 mm upwardly, the stroke amount corresponding to the rotated number of steps, due as mentioned above to the thread engagement effect between the male threaded portion 54*n* on the output shaft 54 of the stepping motor 50 and the female threaded portion 66*w* in the tube shall portion 66 of the valve guide 60, while being driven upwards along the threading from the valve seat 40 of the valve casing 30. This configuration prevents an excessive amount of force from being applied between the valve guide 60 of the closing valve 24 and the valve seat 40 of the valve casing 30 due to the environmental change, i.e., temperature. Besides, in this state, the seal member 76 of the valve body 70 is pressed downward against the upper surface of the valve seat 40 of the valve casing 30 by the spring force caused by the valve spring 77.

Figure 4:
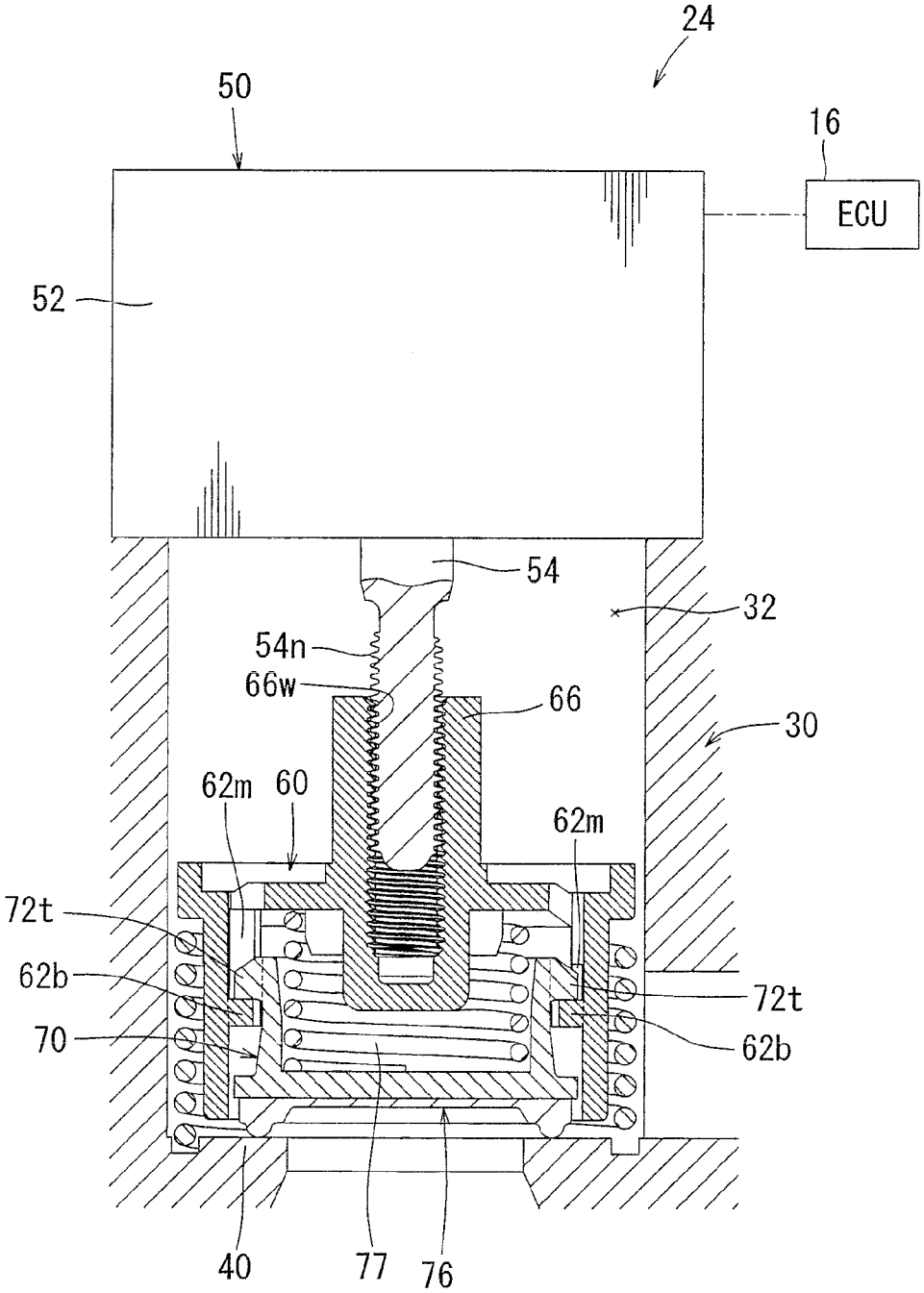
FIG. 4 is a longitudinal sectional view of the same flow rate control valve as shown in FIG. 3 showing a valve closed state.
Figure 5:
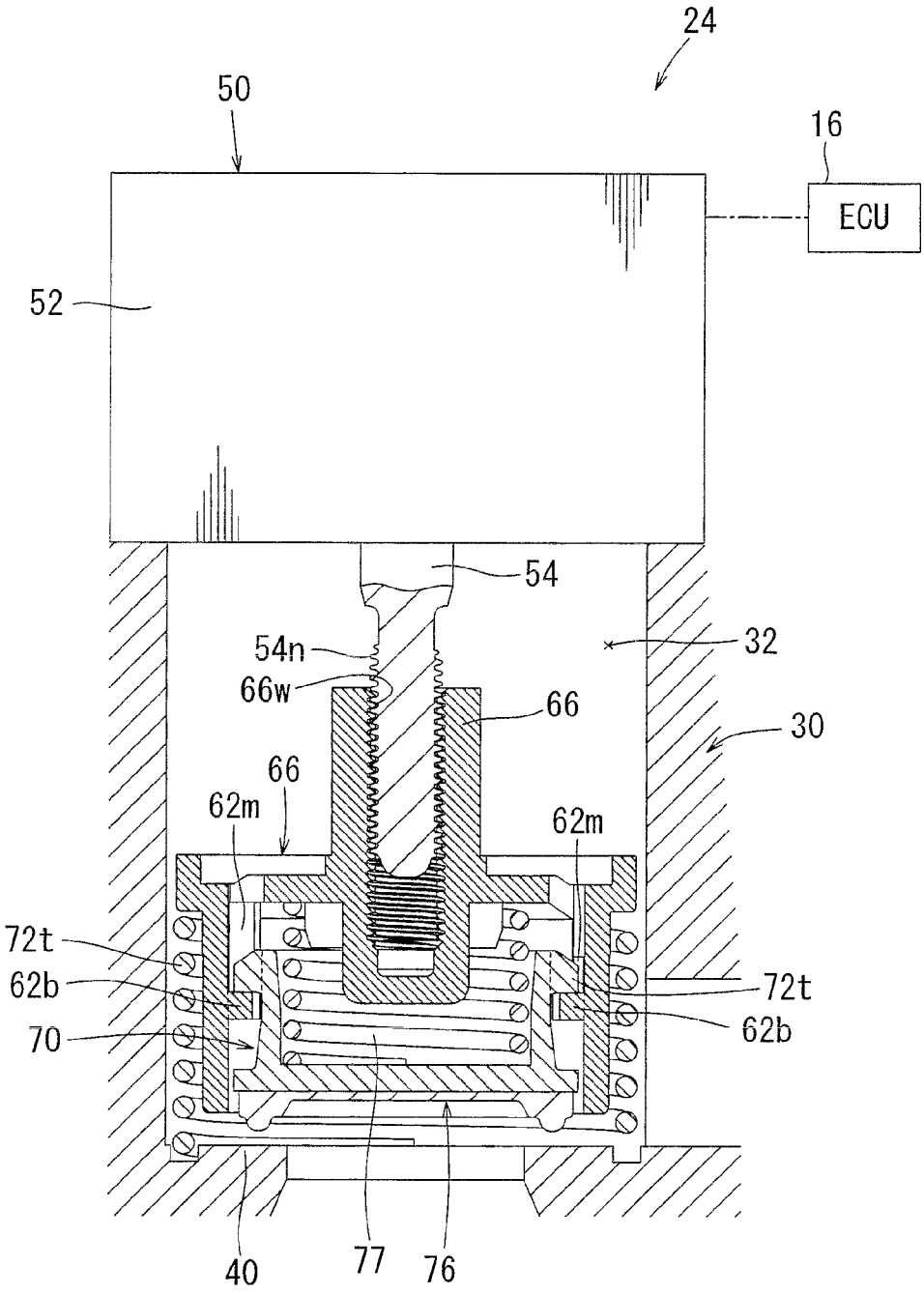
FIG. 5 is a longitudinal sectional view of the same flow rate control valve as shown in FIG. 3 showing a valve opened state.

As shown in FIG. 4, the valve guide 60 moves upwardly due to the thread engagement effect between the male threaded portion 54*n* and the female threaded portion 66*w* when the stepping motor 50 is further rotated from the position after rotating 4 steps, so that the bottom wall portion 62*b* of the valve guide 60 contacts the connection protrusions 72*t* on the valve body 70 from below, as the valve guide 60 moves upwards. As shown in FIG. 5, as the step motor rotates further, the valve body 70 moves upward together with the valve guide 60, because the valve guide 60 further moving upward, through the interaction of bottom wall portion 62*b* with connection protrusion 72*t*, causes the seal member 76 of the valve body 70 to also move upward, and away from the valve seat 40 of the valve casing 30. Accordingly, the closing valve 24 is shifted into the valve open state.

Since the valve opening start position of the closing valve 24 is affected by positional tolerances of the connection protrusions 72*t* formed on the valve body 70 and the positional tolerances of the bottom wall portion 62*b* of the valve guide 60 etc., the valve opening start position must be accurately learned. This learning is accomplished by a learning control routine, in which the number of steps for the valve opening start position is detected and stored while the stepping motor 50 of the closing valve 24 is rotated in the valve open direction (by increasing the number of steps) based on the time when the internal pressure of the fuel tank 15 is reduced such that it is equal to or greater than a predetermined value.

Figure 6:
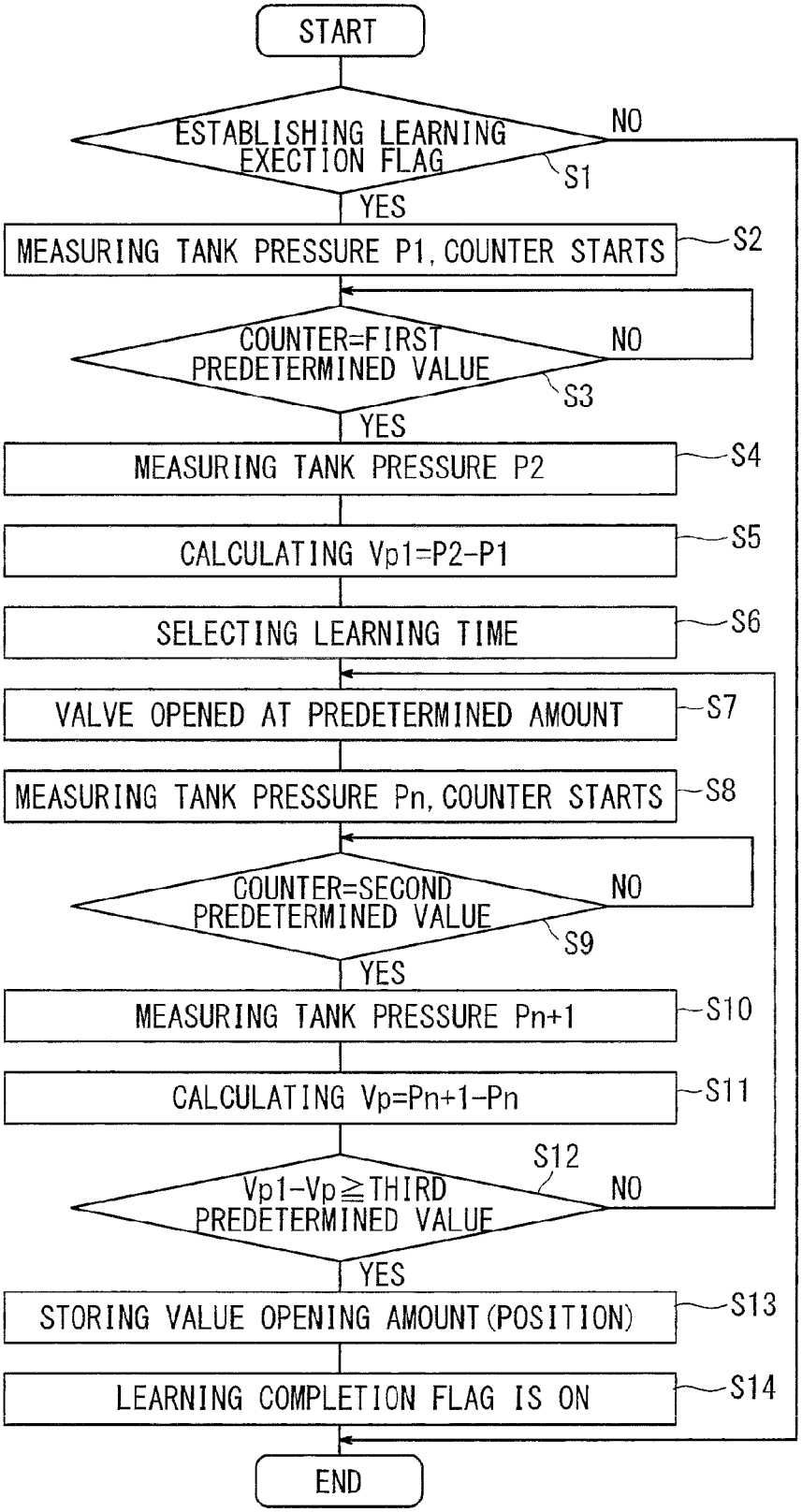
FIG. 6 is a flow chart of a valve opening start position learning control processing routine of the flow rate control valve of the FIG. 2 exemplary embodiment.

The learning control processing routine for the valve opening start position of the step-motor-type closing valve 24 performed in the control circuit 16 will be described based on a flow chart in FIG. 6 as follows. When this routine process is executed, first it is determined whether a learning execution flag is set in step S1. The learning execution flag is set, based on a not shown processing routine, when the condition is suitable for executing the leaning control of the valve opening start position for the step-motor-type closing valve 24. For example, the learning execution flag is set when the ignition switch (not shown) corresponding to a power switch for a vehicle, is turned ON while the vehicle is stopped. When the learning execution flag is set, the step S1 will be determined as positive and the routine moves on to step S2, where the routine ends if the learning execution flag is not set in step S1.

In step S2, the fuel tank internal pressure P1 at that point of time (when the step is executed) is measured by the internal pressure sensor 26, and stored by the control circuit 16. Simultaneously, the time measured by a counter is cleared and a new time measuring commences. In the next step, S3, it is determined whether the counter for measuring time, based on the new time measure started in step S2, has reached a first predetermined value. When the counter reaches the first predetermined value after a preliminary fixed amount of time has passed and the step S3 is determined as positive, then the routine moves to step S4. In step S4, a fuel tank internal pressure P2 at that point of time is measured by the internal sensor 26 and stored by the control circuit 16 similar to the step S2, and the routine moves to step S5. Next, in step S5, a differential pressure Vp1 between the fuel tank internal pressure P1 and P2, which is stored as described above, will be calculated. The differential pressure Vp1 as obtained here corresponds to the variation speed of the fuel tank internal pressure as clearly shown in FIG. 7.

In step S6, learning time will be selected based on the variation speed Vp1 of the fuel tank internal pressure obtained in the step S5. Here, as shown in FIG. 9, the monitoring time, which is the learning time, will be selected based on a map, in which data is stored.

Figure 8:
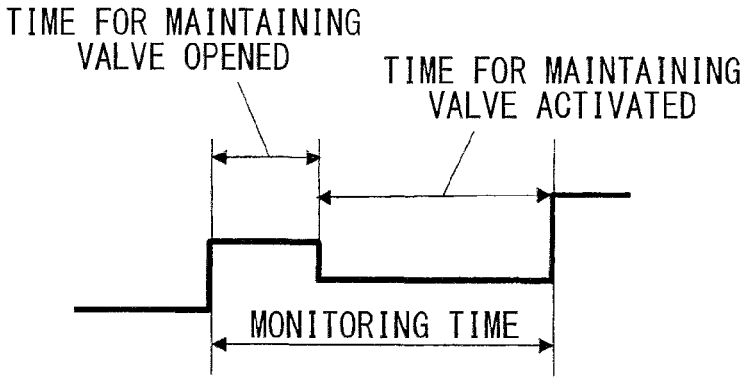
FIG. 8 is an explanatory chart illustrating a valve opening amount control pattern of the flow rate control valve of the FIG. 2 exemplary embodiment.

In the learning control routine for the valve opening start position for the step-motor-type closing valve 24, valve opening control for the closing valve 24 is executed with a pattern shown in FIG. 8. Specifically, a valve opening amount increases stepwise by a predetermined amount in a predetermined cycle (also referred to as monitoring time). At the time when the valve opening amount is stepwise increased, the valve opening amount is further increased for a predetermined time as a time for maintaining valve opened. The increased valve opening amount will be reduced and returned to its original valve opening amount during a time for maintaining the valve activated after a time for maintaining the valve opened has lapsed. The response to the change in the fuel tank internal pressure, if the variation speed of the fuel tank internal pressure is increasing, with respect to the valve opening control for the closing valve 24, will be the increase of monitoring time where the valve opening control for the closing valve 24 is executed in these patterns.

Figure 9:
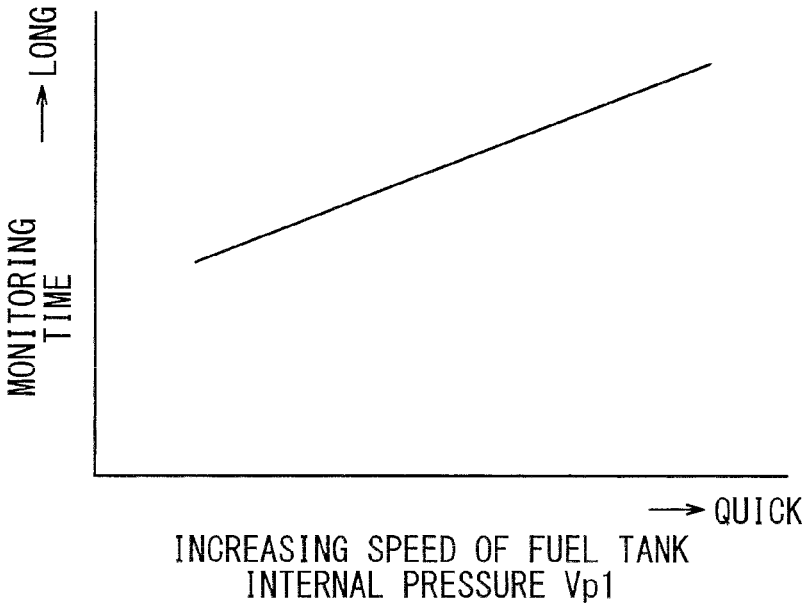
FIG. 9 is an explanatory chart illustrating a map for selecting the learning time for the exemplary embodiment of FIG. 2.

In the selection of the learning time in step S6, a monitoring time at the valve opening control for the closing valve 24 is selected at such a duration as to be proportional to the internal pressure increasing speed Vp1 as shown in FIG. 9. Therefore, as the internal pressure increasing speed Vp1 increases, the monitoring time becomes longer in duration so that the closing valve 24 will be slowly opened, taking time. As a result, the learning time will also be long.

The response to the change in the fuel tank internal pressure by opening of the closing valve 24 may vary in accordance with the changing speed of the fuel tank internal pressure that is caused by conditions other than opening and closing of the closing valve 24. For example, this response of opening the closing valve will be slower as the rising speed of the internal pressure increases while the internal pressure is rising due to increase of the evaporated fuel. If instead the opening speed of the closing valve 24 was not sufficiently slow when the rising speed of the internal pressure increases, then the internal pressure varies such that it passes the valve opening start position to be detected. This delays the detection of the valve opening start position, and thereby the valve opening start position cannot be accurately detected. Conversely, if the opening speed of the closing valve 24 is always reduced in order to solve this problem, the problem of detection delay of the valve opening start position can be solved. However, in this case, a long time is required from the start of closing valve 24 opening until the valve opening start position will be detected. Namely, it may cause a problem of taking time with increase in duration for the learning control of the valve opening start position. According to the present disclosure, it is possible to prevent an increase in time for learning while at the same time enhancing the accuracy in detection of the valve opening start position, if the opening speed is varied by changing the monitoring time during the valve opening control of the closing valve 24 in response to the variation speed Vp1 of the fuel tank internal pressure.

Figure 10:
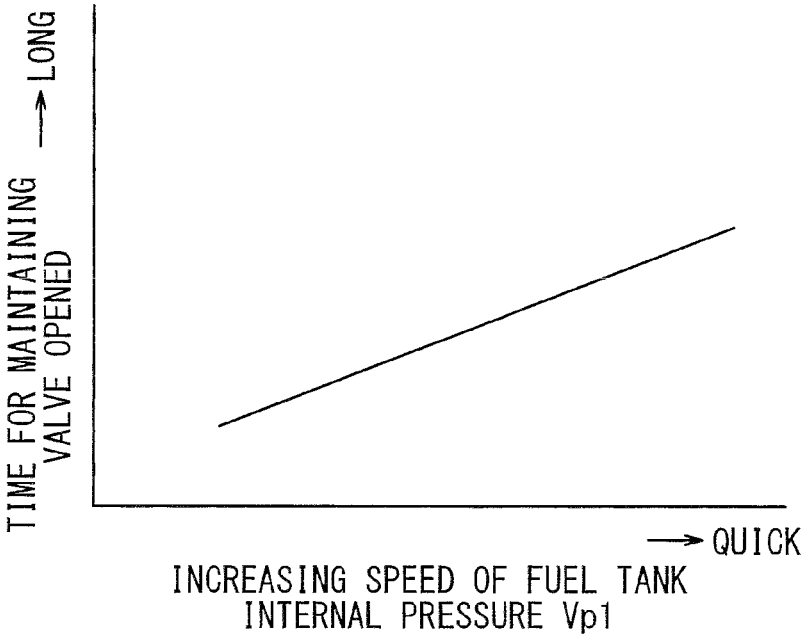
FIG. 10 is an explanatory chart illustrating a modification of the map of FIG. 9 for selecting the learning time for the exemplary embodiment of FIG. 2.

As shown in FIG. 10, the map which is used for selecting the learning time in the step S6, may vary the time for maintaining the valve opened in the control routine during the valve opening control of the closing valve 24. Also, in this case, the time for maintaining the valve opened will be longer as the internal pressure increasing speed Vp1 increases, such that the closing valve 24 will be slowly opened, taking time. The monitoring time will also change in duration in the same manner as the time for maintaining the valve opened has varied.

In the present case, the selection of the learning time in the step S6 is made by using the map, however, it may also be made based on a calculation formula.

In the step S7, the closing valve 24 is opened based on the routine shown in FIG. 8, where in step S8, similar to step S2, the fuel tank internal pressure P at that point of time is measured by the internal pressure sensor 26 and stored. Simultaneously, at the same time of said measuring, the time measured by a counter is cleared and a new time measuring will be started. In the next step, S9, it is determined whether the counter for measuring time, based on the new time measure started in S8, has reached a second predetermined value. The time set as the second predetermined value is regarded as the monitoring time, which is selected in the step S6. If the monitoring time has passed and the counter reached the second predetermined value, then the step S9 is determined as positive, and subsequently a fuel tank internal pressure Pn+1 at that point of time is measured by the internal sensor 26 and stored in step S10, similar to step S2. Next, in step S11, the differential pressure Vp between the fuel tank internal pressures Pn and Pn+1, where Pn and Pn+1 correspond to the stored pressures as described above, will be calculated. The differential pressure Vp as obtained here in step S11 corresponds to the variation speed of the fuel tank internal pressure during the valve opening control for the closing valve 24 as clearly shown in FIG. 7.

Figure 7:
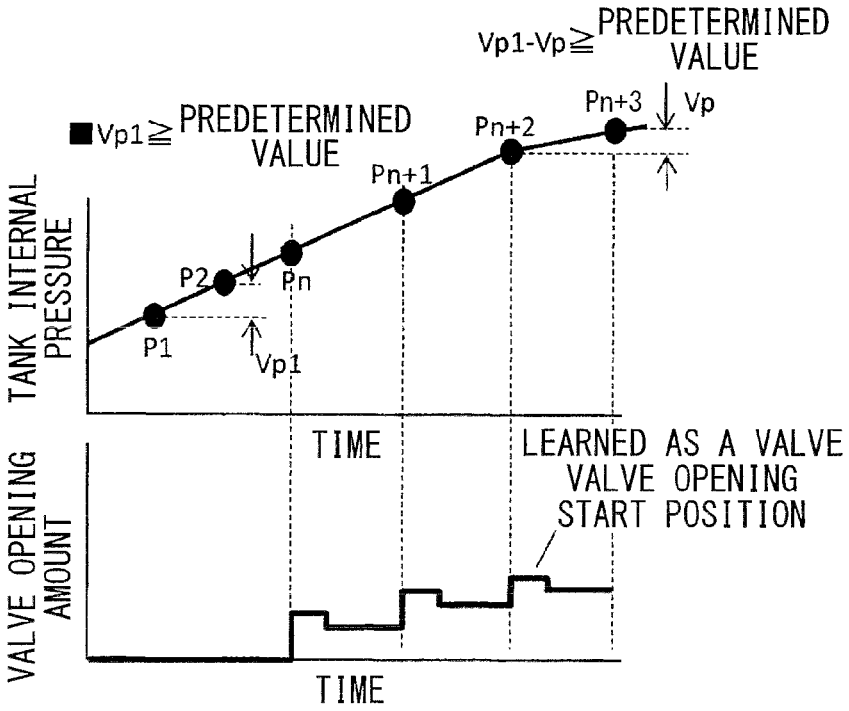
FIG. 7 is a time chart illustrating the change in variation of the fuel tank internal pressure and a valve opening amount of the flow rate control valve of the FIG. 2 exemplary embodiment during the learning control processing routine.

In step S12, it is determined whether the variation range between the differential pressure Vp1 obtained in the step S5 and the differential pressure Vp obtained in the step S11 is equal to or greater than a third predetermined value. The third predetermined value is set at a variation range of pressure corresponding to the condition where fuel tank internal pressure is reduced as the evaporated fuel has started to flow from the fuel tank 15 to the canister 21 when the closing valve 24 reaches the valve opening start position such that the fuel tank 15 is in communication with the canister 21. As shown in FIG. 7, because the variation range of the differential pressure Vp with respect to the differential pressure Vp1 is substantially zero, i.e., is not equal to nor greater than the third predetermined value when the tank internal pressure is Pn+1, Pn+2, the step S12 is determined as negative and the processes after the step S7 will be repeated in this example showing the control routine. The absolute value of the variation range of the differential pressure Vp with respect to the differential pressure Vp1 is equal to or greater than the third predetermined value when the tank internal pressure is Pn+3. Therefore, step S12 is determined as positive and the valve opened position of the closing valve 24 at this point of time is stored as the valve opening start position in the step S13. In fact, the seal member 76 of the valve body 70 for the closing valve 24 moves away from the valve seat 40 of the valve casing 30 so as to open the closing valve 24 (see FIGS. 4 and 5), when the closing valve is stepwise opened at the timing Pn+2, so that, due to the valve opening, as explained above, the fuel tank 15 and the canister 21 are in communication via vapor passage 22 (see FIG. 2). Accordingly, the rising speed of the internal pressure decreases. A learning completion flag is set in the step S14, when the learning control of the valve opening start position for the closing valve 24 is completed. Then, the above-mentioned learning control processing routine will not be executed again until the above-mentioned learning execution flag is subsequently set. The processes in the step S5, the step S11 and the step S12 correspond to obtaining the second-order differential in the present disclosure.

Since the learning control process routine of the valve opening start position for the closing valve 24 is executed as mentioned above, when the opening of the closing valve 24 is subsequently controlled, the closing valve 24 can immediately start to open from the valve opening start position, which is accurately stored as a learned value. Further, by the learning of the valve opening start position, the valve opening start position can be accurately detected regardless of the changes in internal pressure due to environmental factors where the fuel tank 15 is installed, because the reduction of the fuel tank internal pressure is detected as the evaporated fuel starts to flow from the fuel tank 15 to the canister 21 in view of the change in the fuel tank internal pressure at the point of time before the closing valve 24 starts to open for learning, accounting for presence of environmental factors before the control process commences.

Furthermore, it is possible to prevent an increase in time for learning while the accuracy in detection of the valve opening start position is enhanced because the opening speed itself of the closing valve 24 for learning is changed in response to the variation speed of the fuel tank internal pressure during the valve opening start position learning control. More particularly, the rising speed of the fuel tank internal pressure at the point of time before the start of the valve opening control of the closing valve 24 may be calculated by the differential pressure Vp1, and the monitoring time in the valve opening control pattern is changed based on the obtained differential pressure Vp1. The valve opening start position can then be detected without delay since this monitoring time is also a sampling cycle of the internal pressure, and the sampling cycle is extended in response to the rising speed of the internal pressure even when there is a time delay up to the detection of the valve opening start position of the closing valve 24 when the rising speed of the internal pressure is high.

The processes in the step S7 and step S12 according to the above embodiments correspond to the valve opening means according to the present disclosure. Further, the processes in the step S2 to step S5 as well as the step S8 to step S12 correspond to the valve opening start position detecting means according to the present disclosure. Further, the process in the step S13 corresponds to the learning means according to the present intention. Furthermore, the processes in the step S2 to step S6 correspond to the valve opening speed change means according to the present disclosure.

The specific embodiments have been described above, however, the present disclosure is not limited to the appearance or configuration thereof, but various modifications, addition and cancellations are possible within the scope in which the subject matter of the present disclosure will not be changed. For example, according to the above embodiments, the flow rate control valve is configured as the step-motor-type closing valve 24. However, it may also be a ball valve having a configuration where the valve opening amount may be continuously changed due to the rotation of the ball-like valve body. Further, according to the above embodiments, the valve opening control of the flow control valve is configured to further increase the valve opening amount for a predetermined time as a time for maintaining the valve opened at the timing when the valve opening amount is stepwise increased. However, the device may also configured with a control pattern, in which the valve opening amount is increased in a simple stepwise manner without having the time for maintaining the valve opened.

According to the above embodiments, the fuel processing device has a control processing routine which changes in a predetermined cycle, by stepwise increasing the valve opening amount of the flow rate control valve in a set amount of time in order to change the valve opening speed of the flow rate control valve. However, the device may also be configured with a control process routine to change the valve opening amount, which is increased stepwise, without taking into account time for maintaining the valve opened. Further, according to the above embodiments, though the variation speed Vp1 of the fuel tank internal pressure is obtained before the closing valve 24 starts to open, it may also be obtained after the start of the valve opening. Furthermore, according to the above embodiments, the present disclosure was applied to engine systems for vehicles. However, the present disclosure is not limited to vehicles. Even in the realm of engine systems for vehicles, it may be applied to hybrid cars, in which both an engine and a motor are used.

The invention claimed is:

1. An evaporated fuel processing device configured to adsorb evaporated fuel within a fuel tank in a canister and supply the adsorbed evaporated fuel to an engine, utilizing a flow rate control valve as a valve positioned in a passage connecting the fuel tank with the canister, which is maintained in a valve closed state when a stroke amount representing an axially traveled distance of a movable valve part relative to a valve seat from an initial state of the flow rate control valve is less than or equal to a predetermined amount from an initial state so as to allow the fuel tank to be maintained in a sealed state, the evaporated fuel processing device comprising:

a valve opening means for opening the flow rate control valve from the valve closed state at a predetermined speed;

an internal pressure sensor for detecting a space pressure within the fuel tank as an internal pressure;

a valve opening start position detecting means for acquiring a second derivative value of the internal pressure detected by the internal pressure sensor after a valve opening motion of the flow rate control valve has started, and for detecting a valve opening start position of the flow rate control valve based on the second derivative value;

a learning means for storing the valve opening start position detected by the valve opening start position detecting means as a learned value when valve opening control of the flow rate control valve is performed; and a valve opening speed change means for changing a valve opening speed of the valve opening means based on a variation speed of the internal pressure detected by the internal pressure sensor.

2. The evaporated fuel processing device of claim 1, wherein the valve opening means is configured to increase a valve opening amount of the flow rate control valve stepwise by a predetermined amount in a predetermined cycle, and the valve opening speed change means is configured to change the predetermined cycle for increasing the valve opening amount by the valve opening means in response to the variation speed of the internal pressure.

3. The evaporated fuel processing device of claim 1, wherein the valve opening means is configured to increase a valve opening amount of the flow rate control valve stepwise by a predetermined amount in a predetermined cycle, wherein the valve opening amount is further increased by a predetermined period of time as a time for maintaining the valve opened at a timing when the valve opening amount is stepwise increased, and the valve opening speed change means is configured to change the time for maintaining the valve opened by the valve opening means in response to the variation speed of the internal pressure.

4. The evaporated fuel processing device of claim 1, wherein the valve opening speed change means is configured to change the valve opening speed by the valve opening means based on the variation speed of the internal pressure detected by the internal pressure sensor before start of the valve opening motion of the flow rate control valve by the valve opening means.

5. The evaporated fuel processing device of claim 1, wherein the valve opening speed change means is configured to reduce the valve opening speed in response to acceleration in increasing speed of the internal pressure.

6. The evaporated fuel processing device of claim 2, wherein the valve opening speed change means is configured to extend the predetermined cycle by the valve opening means in response to acceleration in increasing speed of the internal pressure.

7. The evaporated fuel processing device of claim 3, wherein the valve opening speed change means is configured to increase the time for maintaining the valve opened by the valve opening means in response to acceleration in increasing speed of the internal pressure.

8. The evaporated fuel processing device of claim 3, wherein the valve opening speed change means is configured to extend the predetermined cycle by the valve opening means in response to acceleration in increasing speed of the internal pressure.

9. An evaporated fuel processing device configured to adsorb evaporated fuel within a fuel tank in a canister and supply the adsorbed evaporated fuel to an engine of a vehicle, utilizing a flow rate control step-motor-type closing valve as a valve positioned in a passage connecting the fuel tank with the canister, which is maintained in a valve closed state when a stroke amount representing the axially traveled distance of a movable valve part relative to a valve seat from an initial state of the valve is less than or equal to a predetermined amount so as to allow the fuel tank to be maintained in a sealed state, the evaporated fuel processing device comprising:

an internal pressure sensor for detecting a space pressure within the fuel tank as an internal pressure;

an electronic control unit comprising a control circuit with controller logic electronically connected to both the internal pressure sensor as well as a stepping motor for rotating an output shaft of a motor in the forward or reverse directions, wherein a male threaded portion is formed on the outer peripheral surface of the output shaft of the stepping motor and is screwed into a female threaded portion on a tube shaft portion of a valve guide of the closing valve, whereby through controlling rotation of the output shaft and the threaded connection of the shaft with the closing valve, the control circuit is able to open the flow rate control valve from a closed state of the valve, at a predetermined speed, wherein said speed comprises a set amount of rotation of the output shaft of the motor per period of time;

wherein the control circuit is configured to perform a learning control process routine for learning the valve opening start position of the step-motor-type closing valve, wherein in said routine, the control circuit commences a valve opening motion by rotation of the output shaft of the motor, opening the closing valve from an initial closed state of the valve, wherein after a valve opening motion has started, the valve opening start position corresponds to the position where the valve opens to a degree such that the fuel tank can start communication with the canister due to the closing valve in the passage being open to a sufficient degree where the fuel can pass through, where said value is stored by the control circuit; wherein after the valve opening motion has started, the control circuit uses a second derivative of the internal pressure detected by the internal pressure sensor in calculating a pressure variation and comparing it to an initial tank pressure variation measured by the internal pressure sensor before the valve is opened, in finding the valve opening start position.

10. The evaporated fuel processing device of claim 9, wherein the device uses the stored value of the valve opening start position for subsequent valve opening control by the motor when the vehicle is parking for faster opening and faster communication between the fuel tank and the canister, compared to the opening of the valve prior to the learning of said value.

11. The evaporated fuel processing device of claim 10, wherein the learning process control routine of the control circuit comprises the initial tank pressure variation, wherein the valve is then cyclically opened based on a monitoring time selected proportional to the prior measured tank pressure variation speed, wherein the valve is opened a predetermined amount by the motor, the tank pressure is measured and a counter is started for the duration of the monitoring time, where once the counter reaches a predetermined value marking the end of the monitoring time, the tank pressure is measured again, and the differential variation in pressure over the period of monitoring time is determined, and compared to the initially measured tank pressure variation, such that, if the difference is greater than or equal to a predetermined value, then the total opening amount is stored as the valve opening start position, but where, if the difference is less than the predetermined value, then the cycle of steps starting after the determination of monitoring time is repeated until the difference is greater than or equal to the predetermined value.

12. The evaporated fuel processing device of claim 10, wherein the air-fuel ratio of the air-fuel mixture supplied to the engine of the vehicle is used by the control circuit together with the fuel tank internal pressure detected by the internal pressure sensor for comparing the pressure variation after the monitoring time period with the initial pressure variation in determining the valve opening start position.

13. The evaporated fuel processing device of claim 11, wherein after the valve opening motion has started, the control circuit uses the second derivative of the internal pressure detected by the internal pressure sensor in calculating the pressure variation and comparing it to the initial pressure variation, in finding the valve opening start position.

14. The evaporated fuel processing device of claim 11, wherein the air-fuel ratio of the air-fuel mixture supplied to the engine of the vehicle is used by the control circuit together with the fuel tank internal pressure detected by the internal pressure sensor for comparing the pressure variation after the monitoring time period with the initial pressure variation in determining the valve opening start position.

15. The evaporated fuel processing device of claim 11, wherein in the selection of monitoring time, if the initial pressure variation over time is increasing, then the monitoring time is for a longer duration, whereas if the initial pressure variation over time is decreasing, then the monitoring time is for a shorter duration.

16. The evaporated fuel processing device of claim 11, wherein the monitoring time comprises a first portion and a second portion, wherein the first portion comprises a period of time where the valve is opened a certain amount, wherein the second portion comprises a period of time where the valve is closed an amount such that it is opened to a greater degree than before the monitoring period but to a lesser degree than the amount opened in the first portion.

* * * * *